US008006330B2

(12) United States Patent
Lee

(10) Patent No.: US 8,006,330 B2
(45) Date of Patent: Aug. 30, 2011

(54) STURDY, COLLAPSIBLE, TELESCOPING BED FRAME

(75) Inventor: Youn Jae Lee, Pleasanton, CA (US)

(73) Assignee: Zinus, Inc., Hayward, CA (US)

( * ) Notice: Subject to any disclaimer, the term of this patent is extended or adjusted under 35 U.S.C. 154(b) by 330 days.

(21) Appl. No.: 12/455,253

(22) Filed: May 29, 2009

(65) Prior Publication Data

US 2010/0299831 A1 Dec. 2, 2010

(51) Int. Cl.
*A47C 19/12* (2006.01)

(52) U.S. Cl. ..... 5/202; 5/201; 5/176.1

(58) Field of Classification Search ..... 5/200.1, 5/201, 202, 174, 176.1, 282.1, 285, 286, 5/312

See application file for complete search history.

(56) References Cited

U.S. PATENT DOCUMENTS

| | | | | |
|---|---|---|---|---|
| 3,881,202 | A * | 5/1975 | Tyhanic | 5/176.1 |
| 7,739,760 | B2 * | 6/2010 | Wang et al. | 5/176.1 |
| 7,784,122 | B2 * | 8/2010 | Oh | 5/201 |
| 2009/0025143 | A1 * | 1/2009 | Oh | 5/201 |
| 2010/0299831 | A1 * | 12/2010 | Lee | 5/202 |

* cited by examiner

*Primary Examiner* — Robert G Santos
(74) *Attorney, Agent, or Firm* — Imperium Patent Works; Darien K. Wallace

(57) ABSTRACT

A collapsible bed frame that supports a box spring includes side rails and telescoping cross rails. A first hinge connects upper and lower portions of a first side rail that are each at least 35 inches long. A first portion of a cross rail telescopes inside a second portion of the cross rail, and the first portion is connected to the first hinge. Upper and lower portions of a second side rail are connected by a second hinge that includes a slot. The second portion of the cross rail has a tongue that fits into the slot on the second hinge. The side rails also have support legs with flanges that extend above the side rails when the support legs are extended. The first and second hinges also include flanges that together with the support leg flanges prevent the box spring from sliding towards either side of the bed frame.

20 Claims, 9 Drawing Sheets

STURDY, COLLAPSIBLE, TELESCOPING BED FRAME

TECHNICAL FIELD

The described embodiments relate to bedding products, and more particularly to a sturdy bed frame assembled from components that are packaged in a compact form for ease of storage and transportation.

BACKGROUND

Conventional bed frames are relatively heavy and awkward. FIG. 1 (prior art) shows the structure of a conventional bed frame 10 including two opposing side rails 11 with a plurality of cross bar members 12 extending between the side rails. Bed frame 10 also includes a center beam 13 that is parallel to the side rails and located at the center of the bed frame in order to provide additional support to a box spring and mattress. The side rails 11 and cross bar members 12 is typically formed from elongated pieces of steel having an L-shaped cross-section (also called angle iron). A horizontal flange of each side rail 11 supports the box spring, and a vertical flange prevents each side rail from bending under the weight of the box spring, the mattress and the occupants of the bed. Thus, the angular arrangement of the side rails is required for structural integrity. In addition, downwardly extending support legs typically screw into threaded leg holders attached to cross bar members 12, center beam 13 and/or side rails 11. The bed frame 10 may support the box spring on wooden slats spanning between the side rails or may directly accommodate the box spring.

The cross bar members 12 are typically formed from multiple sections of the L-shaped metal that overlap each other and can be adjusted to the width of the mattress. Where a king size or California king size mattress is to be supported, each cross bar member 12 includes an extension bar 14 that spans between the other sections of the cross bar member in order to achieve the required length of the assembled cross bar member to span the distance between the side rails 11 to accommodate the larger size box spring and mattress. If two cross bar members 12 were made sufficiently long to accommodate a king or California king size bed without using an extension bar, the cross bar members 12 would be too long for a small bed frame and would extend outwardly beyond the normal width of those bed frames.

When center beam 13 is added to side rails 11, screws are inserted through the mated cross bar members 12 to connect the side rails 11 and to secure center beam 13 to bed frame 10. While the cross bar members 12 are made up of multiple pieces, however, each side rail 11 of a conventional bed frame is a single piece of metal about as long as the box spring and mattress that are to be supported. In order to maintain stability, the side rails of conventional bed frames are not made of multiple overlapping pieces. Thus, the length of the box in which a conventional bed frame is packaged is about as long as the mattress that is to be supported.

Conventional bed frames are typically assembled at the location of the bed. The assembly process can be cumbersome because it usually involves many non-intuitive steps and requires the use of multiple tools. The manner in which multiple pieces are connected to form the cross bar members 12 is typically complicated and can require tools. In addition, the support legs must be screwed or bolted to the cross bar members 12 or side rails 11. Another shortcoming of conventional bed frames is a relatively heavy weight, due primarily to the weight of the steel from which side rails 11 and cross bar members 12 are made. The heavy weight results in higher shipping costs and difficulty of assembly.

Thus, a bed frame assembly is sought that overcomes the shortcomings of conventional bed frames, such as the long length of the packing box for the bed frames, the heavy weight of the bed frames and the complicated assembly that can require tools. The compact, light weight and easily assembled bed frame should nevertheless be sturdy.

SUMMARY

A collapsible, telescoping bed frame is strong, sturdy and easily assembled. Each of the various versions of the bed frame accommodates multiple sizes of box springs. In the folded condition, the collapsible bed frame fits into a packing box that is smaller and lighter weight than the box containing a conventional bed frame. Thus, the collapsible bed frame can be sold in discount department stores without customer assistance, whereas conventional bed frames are sold only at specialty stores that offer assistance for transporting the conventional bed frames to the check-out counter and to customers' vehicles.

The collapsible bed frame includes side rails and telescoping cross rails. The bed frame supports a box spring and a mattress. A first hinge pivotally connects upper and lower portions of a first side rail that are each at least 35 inches long. A first portion of a cross rail telescopes inside a second portion of the cross rail, and the first portion is pivotally connected to the first hinge. In the assembled condition, the portions of the side rail and cross rail are fully extended and are all parallel to the floor on which the bed frame is assembled.

In the assembled condition, a second side rail is parallel to the first side rail. Upper and lower portions of the second side rail are pivotally connected by a second hinge that includes a slot. The second portion of the cross rail has a tongue that fits into the slot on the second hinge. The side rails also have support legs with flanges that extend above the upper surface of the side rails when the support legs are extended. The first and second hinges also include flanges that together with the flanges of the support legs prevent the box spring from sliding toward either side of the bed frame. Edge attachments are attached to the ends of the side rails and prevent the box spring from sliding toward the head or foot of the bed frame.

The side rails and cross rails are hollow metal tubes with a square cross section. The collapsible bed frame is light weight because the metal of the hollow tubes is less than one sixteenth of an inch thick. Even though the metal of the L-shaped angle iron of a conventional bed frame is much thicker, the square metal tubes of the collapsible bed frame are stronger because the metal supports all sides of the tube as opposed to just two perpendicular sides of an angle iron.

The collapsible bed frame is sturdy because it has nine support legs as opposed to the four or six legs of a conventional bed frame. Two of the nine support legs are attached to the two hinges. Seven of the nine support legs are pivotally attached to the side rails and cross rails. The seven support legs pivot from a folded position to an extended position. Each of the seven support legs includes a flange that extends above the upper surface of the rails when the support leg is in the extended position. The flanges do not protrude above the rails when the support legs are in the folded position.

The bed frame can be assembled for use from a kit of components. The components are placed together in a compact packing box for ease of storage and transportation. Therefore, storage space requirements and shipping bulk are reduced. The components of the bed frame are designed such that they may be nested together in the compact, light-weight packing box that is less than 45 inches long and whose width and height are each less than 7 inches. The packing box containing the collapsible bed frame can be carried by a single purchaser. The components that are packaged into the packing box include side rails, cross rails, support legs and edge attachments. Each side rail includes an upper portion, a lower portion and a hinge. The hinges pivotally connect the upper portions to the lower portions. The cross rails include first portions and second portions that telescope into one another. A first portion of the middle cross rail is pivotally connected to the hinge that also connects the upper and lower portions of one of the side rails.

The purchaser of the collapsible bed frame is instructed to remove the folded and collapsed bed frame from the packing box, to assemble the collapsible bed frame, and to place a box spring on top of the assembled collapsible bed frame.

Other embodiments and advantages are described in the detailed description below. This summary does not purport to define the invention. The invention is defined by the claims.

BRIEF DESCRIPTION OF THE DRAWINGS

The accompanying drawings, where like numerals indicate like components, illustrate embodiments of the invention.

DETAILED DESCRIPTION

Reference will now be made in detail to some embodiments of the invention, examples of which are illustrated in the accompanying drawings.

Figure 1:
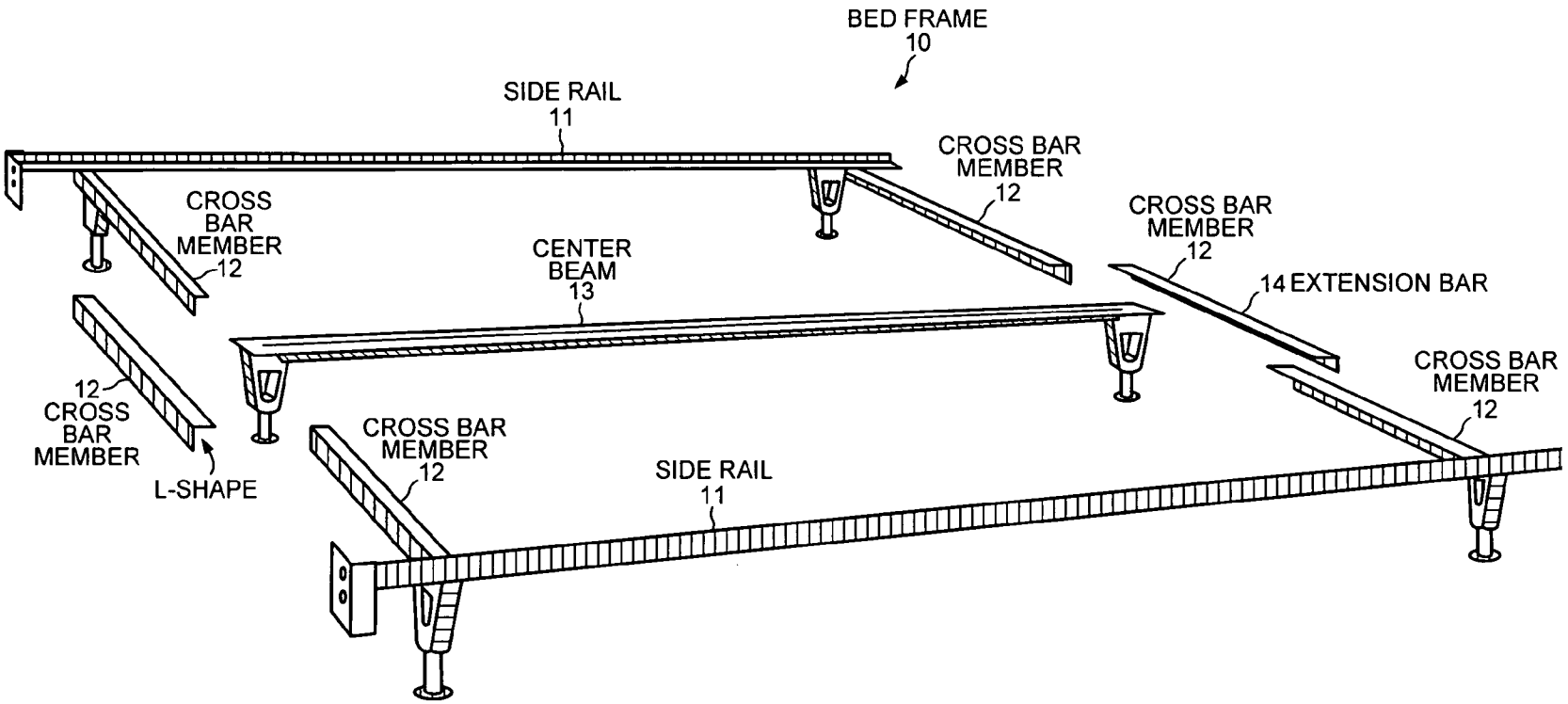
(PRIOR ART) FIG. 1
FIG. 1 (prior art) is a perspective view of a prior art bed frame with rails having an L shape.
Figure 2:
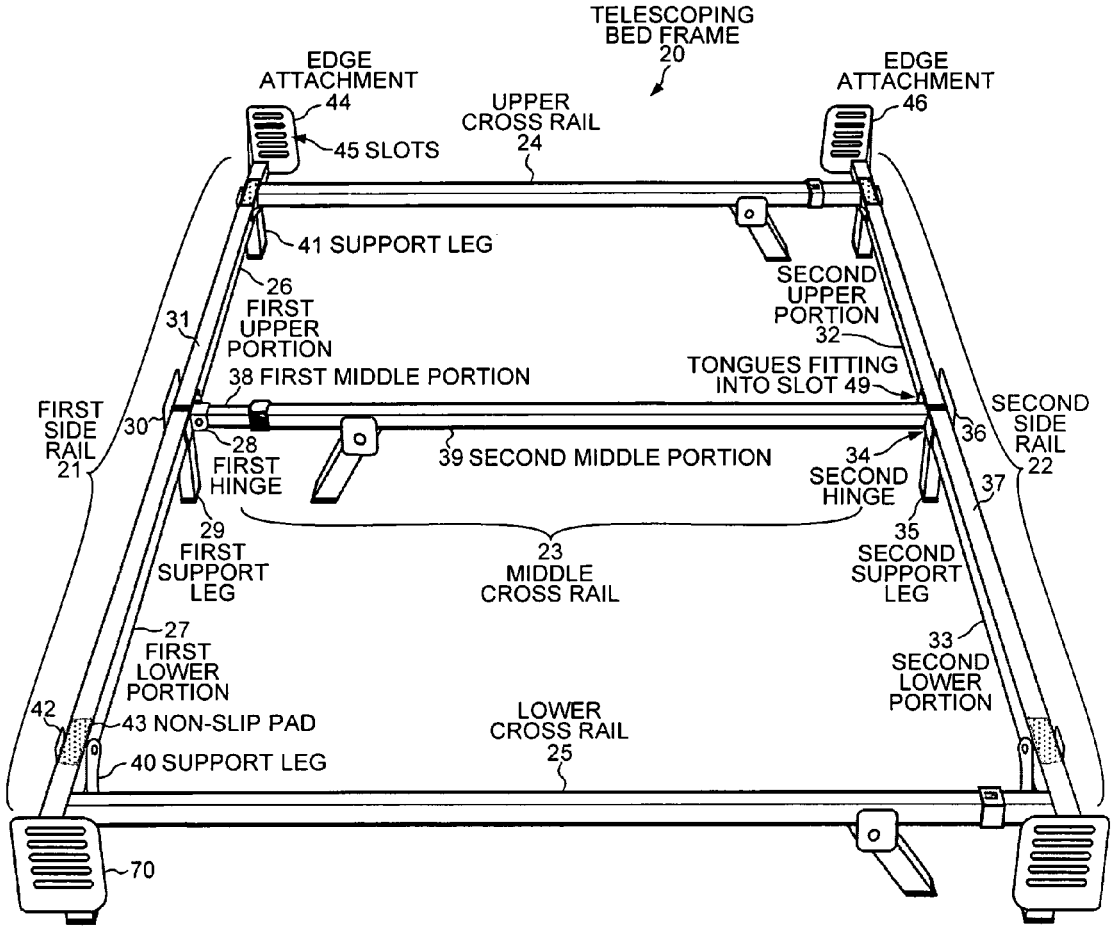
FIG. 2 is a perspective view of a collapsible, telescoping bed frame with rails having square cross sections.

FIG. 2 shows a collapsible, telescoping bed frame 20. Bed frame 20 includes a first side rail 21, a second side rail 22, a middle cross rail 23, an upper cross rail 24 and a lower cross rail 25. FIG. 2 shows bed frame 20 in an assembled condition. In the assembled condition, first side rail 21 is parallel to second side rail 22. In addition, middle cross rail 23, upper cross rail 24 and lower cross rail 25 are parallel to each other.

First side rail 21 includes a first upper portion 26, a first lower portion 27 and a first hinge 28. First hinge 28 pivotally connects first upper portion 26 to first lower portion 27. A first support leg 29 is fixedly attached to first hinge 28. First hinge 28 includes a flange 30 on the outer side of first side rail 21 that protrudes above the upper surface 31 of first side rail 21. Second side rail 22 includes a second upper portion 32, a second lower portion 33 and a second hinge 34. Second hinge 34 pivotally connects second upper portion 32 to second lower portion 33. A second support leg 35 is attached to second hinge 34. Second hinge 34 includes a flange 36 on the outer side of second side rail 22 that protrudes above the upper surface 37 of second side rail 22.

Middle cross rail 23 includes a first middle portion 38 and a second middle portion 39. In the embodiment of FIG. 2, first middle portion 38 telescopes inside second middle portion 39. In another embodiment, second middle portion 39 telescopes inside first middle portion 38. First middle portion 38 is pivotally connected to first hinge 28. First hinge 28 has three hinge axes that do not move relative to first support leg 29 and flange 30. First upper portion 26 pivots about the first axis; first lower portion 27 pivots about the second axis; and first middle portion 38 pivots about the third axis. In the assembled condition, each of first upper portion 26, first lower portion 27 and first middle portion 38 is rotated about the axes of first hinge 28 such that the portions 26, 27 and 38 all lie in a single plane. Second hinge 34 includes two grooves of a slot opposite flange 36. Second middle portion 39 includes two tongues on an end opposite first hinge 28. The two tongues of second middle portion 39 fit into the two grooves of the slot on second hinge 34.

Bed frame 20 is supported by a total of nine leg supports. In addition to first support leg 29, two hinged support legs 40-41 are pivotally attached to first side rail 21. Support leg 40 is pivotally attached to first lower portion 27 and can pivot from a folded position to an extended position. In the assembled condition of bed frame 20, support leg 40 is in the extended position. Support leg 40 includes a flange 42 that extends above upper surface 31 of first lower portion 27 when support leg 40 is in the extended position. When support leg 40 is in the folded position, flange 42 does not protrude above upper surface 31. Support leg 41 has a flange that protrudes above upper surface 31 when support leg 41 is extended in a manner similar to flange 42. Adjacent to flange 42, there is a non-slip pad 43 on upper surface 31. Non-slip pad 43 prevents a box spring sitting atop bed frame 20 from slipping. Likewise, there are non-slip pads above support leg 41 and above the two support legs at the ends of second side rail 22. Flanges 30, 36 and 42, as well as the three other flanges connected to the other three support legs that are attached to side rails, form a frame that holds the box spring in place on the upper surfaces of the side rails and cross rails. The flanges prevent the box spring from sliding off the side of either side rail. Each of the three cross rails 39 and 24-25 has a support leg similar to support leg 40, except that no flange extends when the support legs on the cross rails are extended.

In one embodiment, edge attachments are inserted into both ends of each side rail. For example, an edge attachment 44 is inserted into first upper portion 26 at the end opposite first hinge 28. Edge attachment 44 has an end plate with slots 45 and a short tube with a square cross section. The square cross section of the short tube is slightly smaller than the square cross section of first upper portion 26 and telescopes inside portion 26. A depressible catch button on the short tube pops out through a hole in first upper portion 26 and locks edge attachment 44 in place. The edge attachments on the other three ends of the side rails are formed analogously. The edge attachments prevent the box spring from sliding towards the head of the bed (towards upper cross rail 24) or towards the foot of the bed. In addition, a headboard can be attached to edge attachment 44 and to an edge attachment 46 at the end of second upper portion 32. Tongues on the headboard slip into the slots 45 in edge attachments 44 and 46.

Upper cross rail 24 and lower cross rail 25 telescope in a manner similar to that of middle cross rail 23. Upper cross rail 24 and lower cross rail 25, however, are connected to the side rails only by tongue-and-slot connectors and not by hinges. Thus, each of the cross rails 23-25 can be extended to different lengths by inserting the first portions of the cross rails farther into the second portions of the cross rails. By adjusting the length of the cross rails, telescoping bed frame 20 can accommodate box springs and mattresses of multiple sizes. To maintain the stability of the cross rails, however, some distance of the first portion must remain telescoped inside the second portion. In one embodiment, at least twelve inches of second middle portion 39 must remain overlapping first middle portion 38 to maintain the stability of telescoping bed frame 20.

For example, an eastern king size mattress is 76 inches wide and 80 inches long. Each side of the square cross section of the side rails is about one inch long in one embodiment. So the cross rails must span 74 inches to accommodate an eastern king size mattress. In order to achieve the shortest length of the longer portion of each cross rail, the two portions are made to have approximately equal lengths. Each telescoping portion of the cross rails must be longer than 37 inches in order to maintain some overlap of the telescoping portions. In one embodiment, for example, each portion of the cross rails is 45 inches long, which provides 16 inches of overlap when extended to accommodate an eastern king size box spring. A twin (single) size mattress is 39 inches wide and 75 inches long. When the 1-inch-wide side rails are accounted for, the cross rails must span 37 inches to accommodate a twin size mattress. And each of first middle portion 38 and second middle portion 39 of middle cross rail 23 must be somewhat shorter than 37 inches to leave room for first hinge 28. Therefore, the portions of the cross rails that must be longer than 37 inches to accommodate an eastern king size mattress are too long to accommodate a twin size mattress. Consequently, different lengths of telescoping cross rails are used for the versions of bed frame 20 that accommodate small mattresses and large mattresses.

In one implementation, telescoping bed frame 20 is manufactured in three versions: a first version that accommodates box springs for mattresses of sizes twin (single), full (double) and queen; a second version that accommodates box springs for twin and full size mattresses, and a third version that accommodates box springs for queen, eastern king and California king size mattresses. The first version has cross rail portions that are 35 inches long and side rails whose upper and lower portions are 37 inches long. The second version has cross rail portions that are 32 inches long and side rails whose upper and lower portions are 37 inches long. And the third version has cross rail portions that are 43 inches long and side rails whose upper and lower portions are 39.5 inches long.

The length of the portions of the cross rails for each version is chosen to be long enough to have a minimum required overlap (e.g., 12 inches) when used with the widest box spring for the version and short enough to allow for a couple of inches of non-overlapping length when used with the narrowest box spring for the version. For example, when the first version is used with a queen size box spring, the 35-inch portions of the cross rails overlap each other by 12 inches. When the 35-inch portions of the cross rails of the first version are used with a twin size box spring, two inches on either side of the 37-inch span between the side rails are not overlapped by both portions of the cross rails and leave room for first hinge 28. When the third version is used with a queen size box spring, 15 inches on either side of the 58-inch span between the side rails are not overlapped by both 43-inch portions of the cross rails. When the third version is used with an eastern king size box spring, the 43-inch portions of the cross rails overlap each other by 12 inches.

The upper and lower portions of the side rails for the first and second versions are 37 inches long. Thus, in the extended position in the assembled condition, each side rail is 74 inches long. The edge attachments at the head and foot of bed frame 20 together add an additional one inch to the length of the side rails so as to accommodate box springs for twin and full size mattresses having lengths of 75 inches. A queen size box spring fits on the first version if the edge attachments at the foot of bed frame 20 are removed, and the queen size box spring hangs over the foot of bed frame 20 by about five inches.

For the third version of bed frame 20, the upper and lower portions of the side rails are 39.5 inches long. Each side rail is 79 inches long in the extended position. The edge attachments add an additional one inch to the side rails so as to accommodate box springs for queen and eastern king size mattresses having lengths of 80 inches. A California king size box spring fits on the third version if the edge attachments at the foot of bed frame 20 are removed, and the California king size box spring hangs over the foot of bed frame 20 by about four inches.

The components of collapsible, telescoping bed frame 20 fit into a compact, light-weight packing box that is smaller and weighs less than the packing box containing conventional bed frame 10. Each side rail 11 of conventional bed frame 10 is a single piece of angle iron. Thus, the packing box for conventional bed frames is typically more than 75 inches long. In contrast, the packing box containing bed frame 20 in a folded condition has a length that is longer than 35 inches but at least as short as 45 inches, and a width and a height that are each no greater than 7 inches. For example, the third version of bed frame 20 that accommodates a California king size mattress has first and second cross rail portions that are each 43 inches long. The upper and lower portions of the side rails of the third version are each 39.5 inches long. Thus, the third version of bed frame 20 fits into a packing box that is about 44 inches long. The telescoping portions of the cross rails are not removed from each other in the folded condition in the packing box; rather, they are telescoped and compressed. In the folded condition, the upper and lower portions 26-27 of first side rail 21 and middle cross rail 23 are folded together around the three axes of first hinge 28. The upper and lower portions 32-33 of second side rail 22 are folded about the two axes of second hinge 34. Cross rails 24-25 are placed separately in the packing box. Thus, the packing box contains seven long square tubes as well as the nine support legs in folded positions. The four edge attachments are placed at the top of the packing box. All of these components fit in a box that is about 7 inches wide, about 5.75 inches high and about 44 inches long.

In addition, the L-shaped steel of the side rails 11 of conventional bed frame 10 must be much thicker than the steel of side rails 21-22 with a square cross section. For example, the L-shaped steel of a conventional bed frame is typically at least one-eighth of an inch thick, and both sides of the "L" are 1.25 inches wide. The steel for an L-shaped rail must be thicker than for a rail with a square cross section in order to provide the same structural integrity because the L-shaped steel provides support only on two sides. Side rails 21-22 of bed frame 20 provide adequate support for even the weight of a king size box spring, mattress and person(s) using metal having a thickness of less than one sixteenth of an inch. Side rails 21-22 are made of a hollow tube of steel having a square cross section with sides about one inch long. Steel sheets of a thickness of less than one sixteenth of an inch are bent along three parallel folds and are then welded at the edges to form the fourth corner of the square tube. The weight of bed frame 20 is therefore much less than the weight of conventional bed frame 10.

By assembling the components of bed frame 20 only after the packing box has been transported to the location of the box spring to be supported, damage to stair wells, elevators and doorways can be avoided. The long and heavy side rails 11 of conventional bed frame 10, and even the packing box containing the bed frame 10, are difficult to maneuver without damaging stair wells, elevators and doorways. The packing box containing the components of bed frame 20 is more easily maneuvered up stairs, into apartment elevators and around corners. In addition, the packing box containing the components of bed frame 20 is so light and compact that it can lifted by the average customer in a mass-market, general merchandise retail store (a discount department store) into a shopping cart and taken to the check-out counter. Thus, bed frame 20 can be sold in a discount department store without customer assistance, whereas conventional bed frame 10 can be sold only at specialty stores that offer assistance (personnel or special carts) for transporting the conventional bed frame to the check-out counter and to the customer's vehicle.

Figure 3:
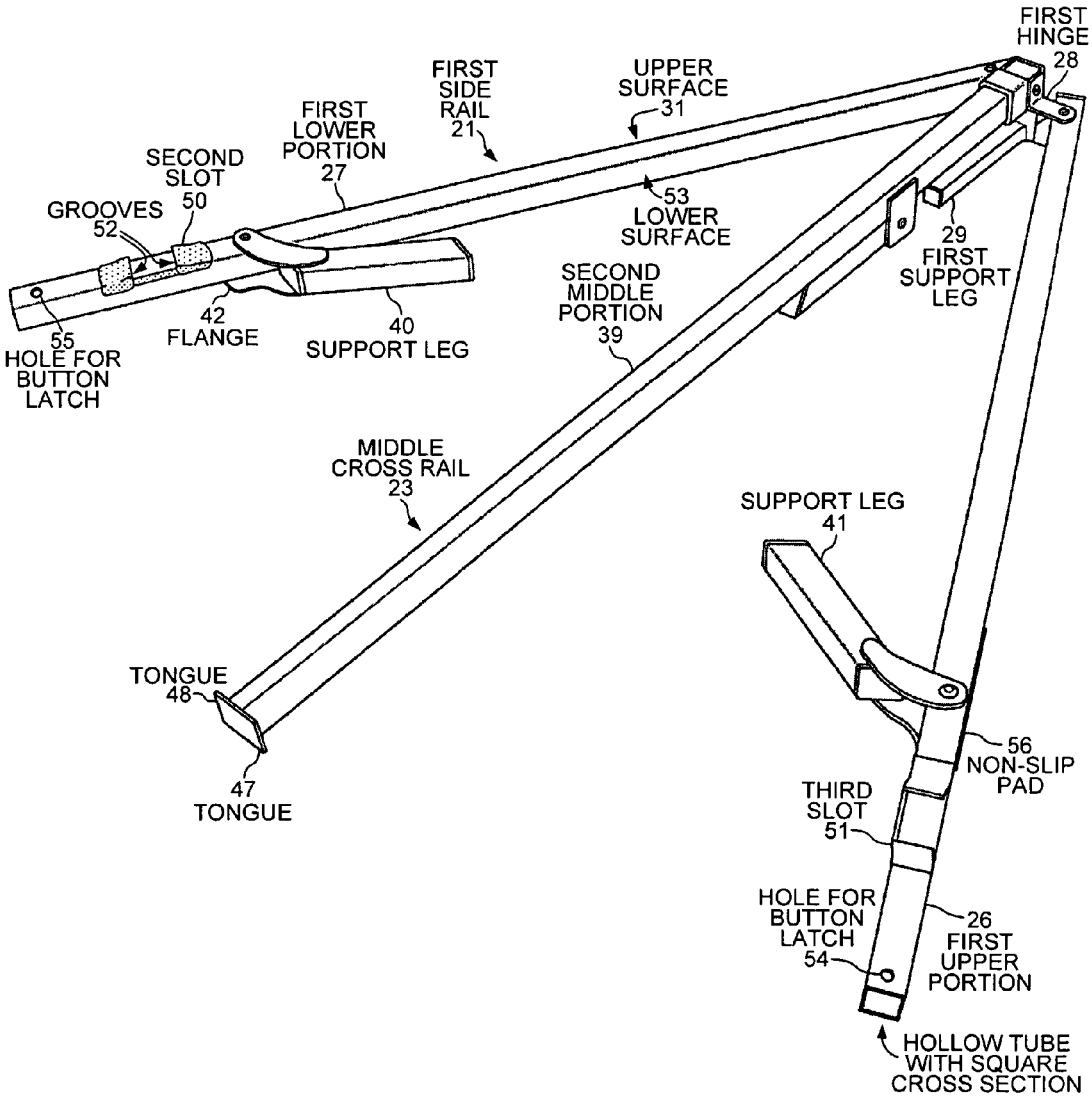
FIG. 3 is a more detailed view of portions of a side rail and cross rail that are connected by a hinge having three axes.

FIG. 3 shows first side rail 21, middle cross rail 23 and first hinge 28 in more detail. Middle cross rail 23 is in a folded position as the rail would be placed in a packing box. First lower portion 27 and first upper portion 26 are only partially unfolded. The end of first upper portion 26 opposite first hinge 28 illustrates that first side rail 21 is a hollow tube with a square cross section. Two tongues 47-48 extend perpendicularly to middle cross rail 23 at the end of second middle portion 39 opposite first hinge 28. Tongues 47-48 of second middle portion 39 fit into the two grooves of a first slot 49 on second hinge 34. In addition to first slot 49 on second side rail 22, a second slot 50 and a third slot 51 are disposed on the inner surface of first side rail 21. Moreover, additional slot features are located towards each end of second side rail 22 and are sized to receive the dual tongue connectors attached to the inner square tubes of upper cross rail 24 and lower cross rail 25. Tongues on one end of the outer portion of lower cross rail 25 fit into two grooves 52 of second slot 50. Similarly, tongues on one end of the outer portion of upper cross rail 24 fit into the grooves of third slot 51. In another embodiment, the position of the inner and outer square tubes of the cross rails can be reversed.

In FIG. 3, support leg 40 is only partially unfolded, and flange 42 is below the lower surface 53 of first lower portion 27. Flange 42 does not extend above upper surface 31 of first lower portion 27 until support leg 40 is in the extended position. FIG. 3 also shows a hole 54 through which a depressible catch button on the short tube of edge attachment 44 pops out to lock edge attachment 44 in place at the head end of first upper portion 26. There is also a hole 55 at the foot end of first lower portion 27 that is used by the button latch that attaches an edge attachment to the foot end of first side rail 21. A non-slip pad 56 is shown on upper surface 31 of first side rail 21 opposite support leg 41.

Figure 4:
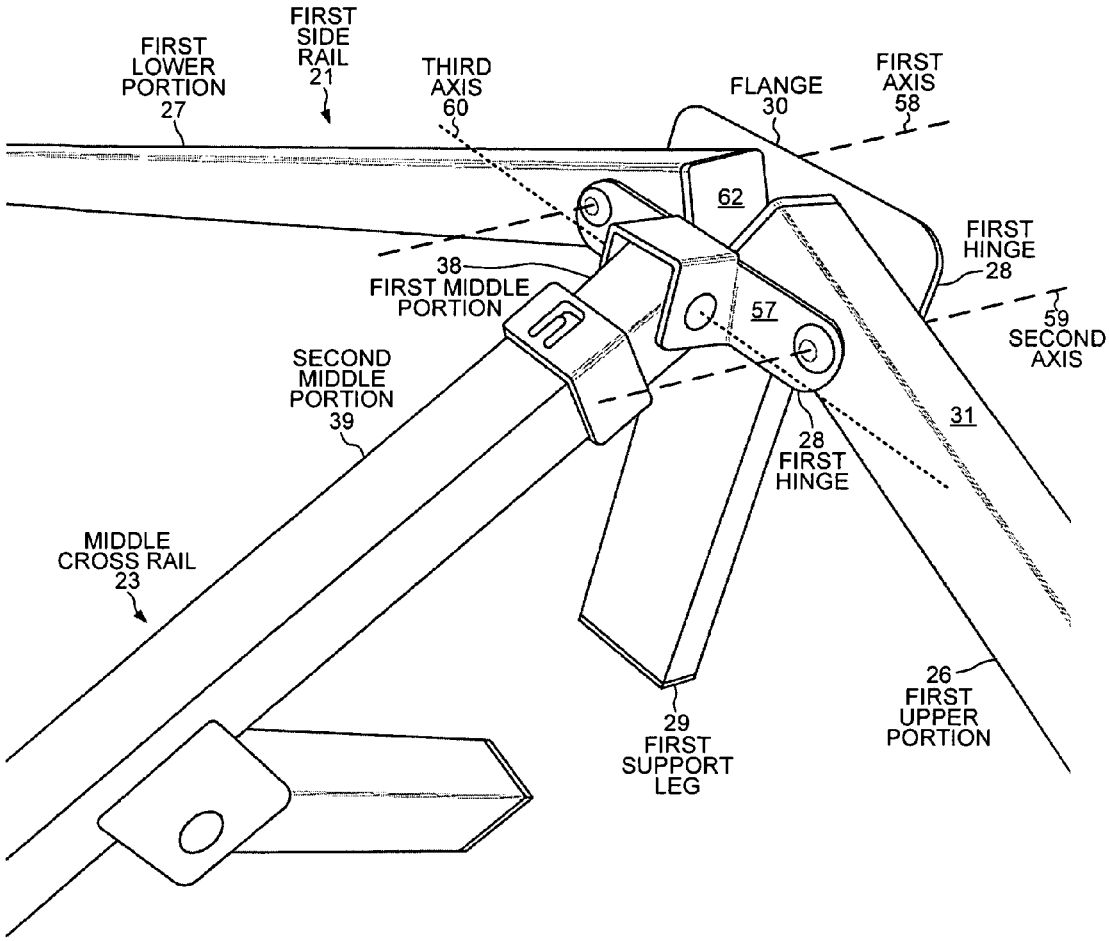
FIG. 4 is a more detailed view of the 3-axis hinge of FIG. 3.

FIG. 4 shows first hinge 28 in more detail. First hinge 28 includes flange 30 on the outer surface of first side rail 21 as well as an inner hinge portion 57 on the inner surface of first side rail 21. Flange 30 protrudes above the upper surface 31 of first side rail 21 when first upper portion 26 and first lower portion 27 are extended and bed frame 20 is in the assembled condition. First support leg 29 is fixedly attached to flange 30 of first hinge 28. First hinge 28 has three hinge axes 58-60 that do not move relative to flange 30. The three hinge axes 58-60 lie in a single plane. First upper portion 26 pivots about first axis 58. First lower portion 27 pivots about second axis 59. The ends 61-62 of upper and lower portions 26-27, respectively, contact each other when portions 26-27 are fully extended. In one embodiment, ends 61-62 are plastic caps that fit into the square metal tubes of portions 26-27. First middle portion 38 of middle cross rail 23 pivots about third axis 60.

Figure 5:
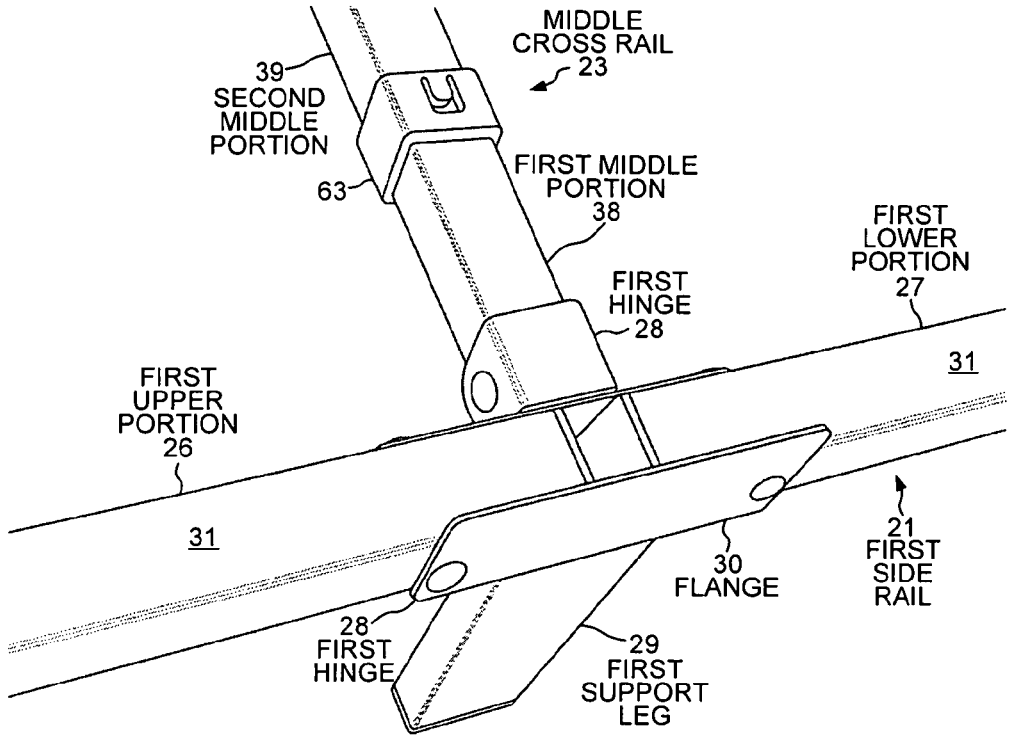
FIG. 5 shows the hinge of FIG. 3 in which the portions of the side rail and cross rail are fully extended.

FIG. 5 shows first hinge 28 in the assembled condition in which first upper portion 26, first lower portion 27, and first middle portion 38 are fully extended. In the assembled condition, each of first upper portion 26, first lower portion 27, and first middle portion 38 is parallel to the floor on which collapsible, telescoping bed frame 20 is assembled. FIG. 5 also shows a plastic ring 63 on one end of second middle portion 39 that prevents first middle portion 38 from rattling inside second middle portion 39 and makes bed frame 20 quieter and more stable.

Figure 6:
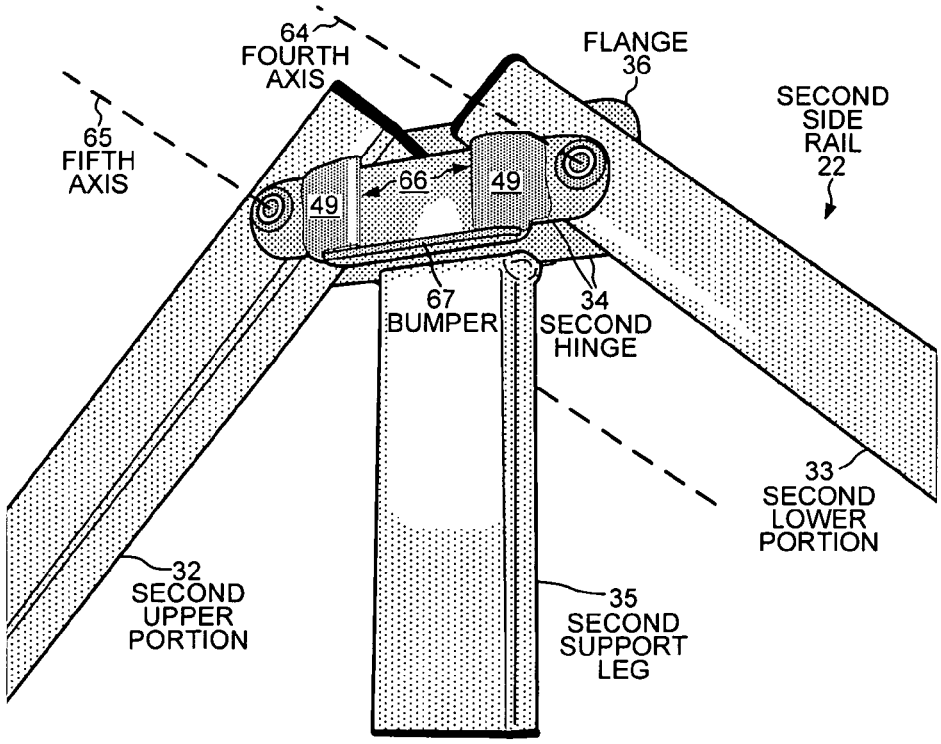
FIG. 6 is a detailed view of a second hinge that includes a slot and that connects portions of a second side rail.

FIG. 6 shows second hinge 34 in more detail. Second hinge 34 includes flange 36 on the outer side of second side rail 22. Second support leg 35 is attached to flange 36 of second hinge 34. Second hinge 34 has a fourth axis 64 and a fifth axis 65. Second lower portion 33 rotates about fourth axis 64, and second upper portion 32 rotates about fifth axis 65. Second hinge 34 includes two grooves 66 in first slot 49 on the opposite side of second side rail 22 from flange 36. The two tongues at the end of second middle portion 39 slide into the two grooves 66 of first slot 49. The tongues rest on bumper 67 after being slid all the way into slot 49.

Figure 7:
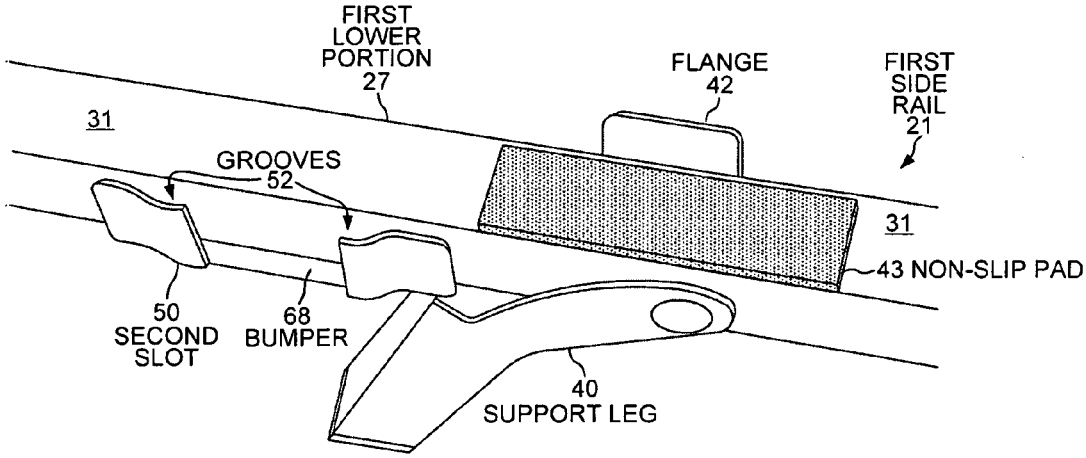
FIG. 7 is a view of another slot disposed on a portion of the side rail that is connected by the first hinge.

FIG. 7 shows second slot 50 on first lower portion 27 in more detail. The two tongues at one end of lower cross rail 25 slide into the two grooves 52 of second slot 50. The tongues rest on a bumper 68 after being slid all the way into slot 50. FIG. 7 also shows flange 42 extending above upper surface 31 of first lower portion 27 with support leg 40 in the extended position.

Figure 8:
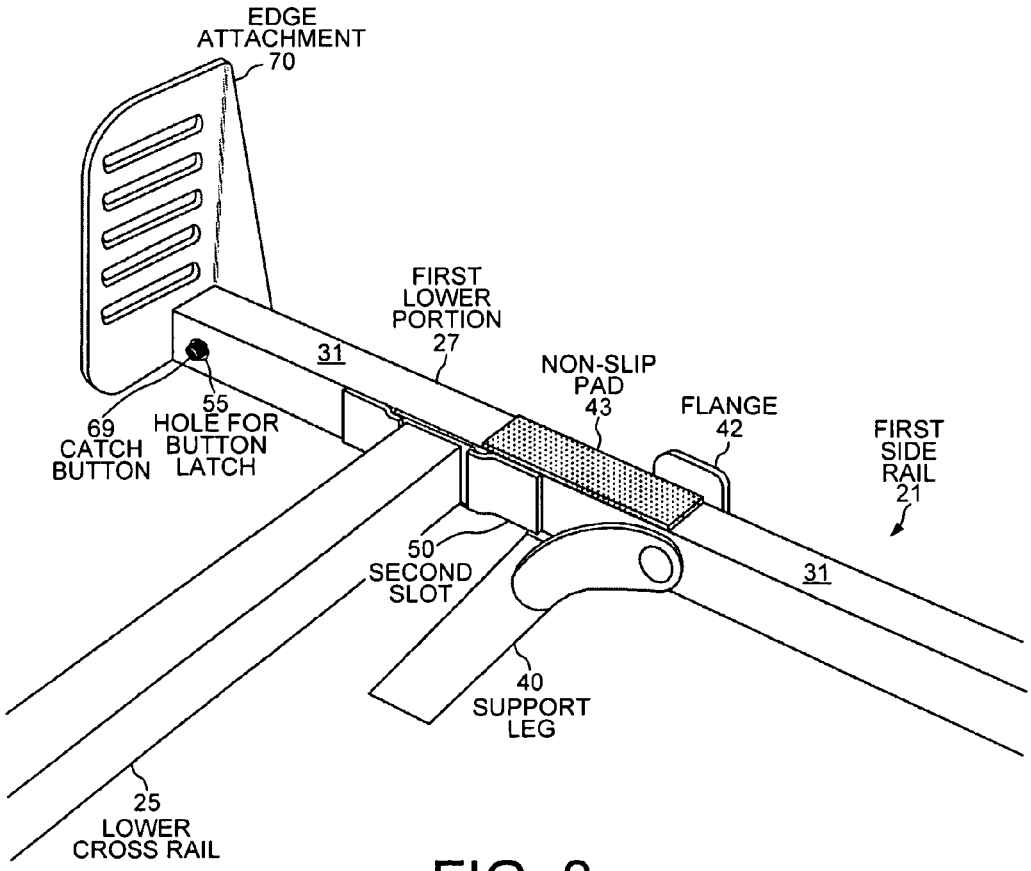
FIG. 8 is a perspective view of a lower cross rail attached to a side rail at the slot of FIG. 7.

FIG. 8 shows first lower portion 27 attached to lower cross rail 25 using second slot 50 in the assembled condition of bed frame 20. The tongues at one end of lower cross rail 25 have been inserted into second slot 50. FIG. 8 also shows a depressible catch button 69 on the short tube of an edge attachment 70 protruding through hole 55 in first lower portion 27. Catch button 69 has popped out and is locking edge attachment 70 in place at the foot end of first side rail 21. Edge attachment 70 holds queen and eastern king size box springs from sliding past the foot of the bed frame 20.

Figure 9:
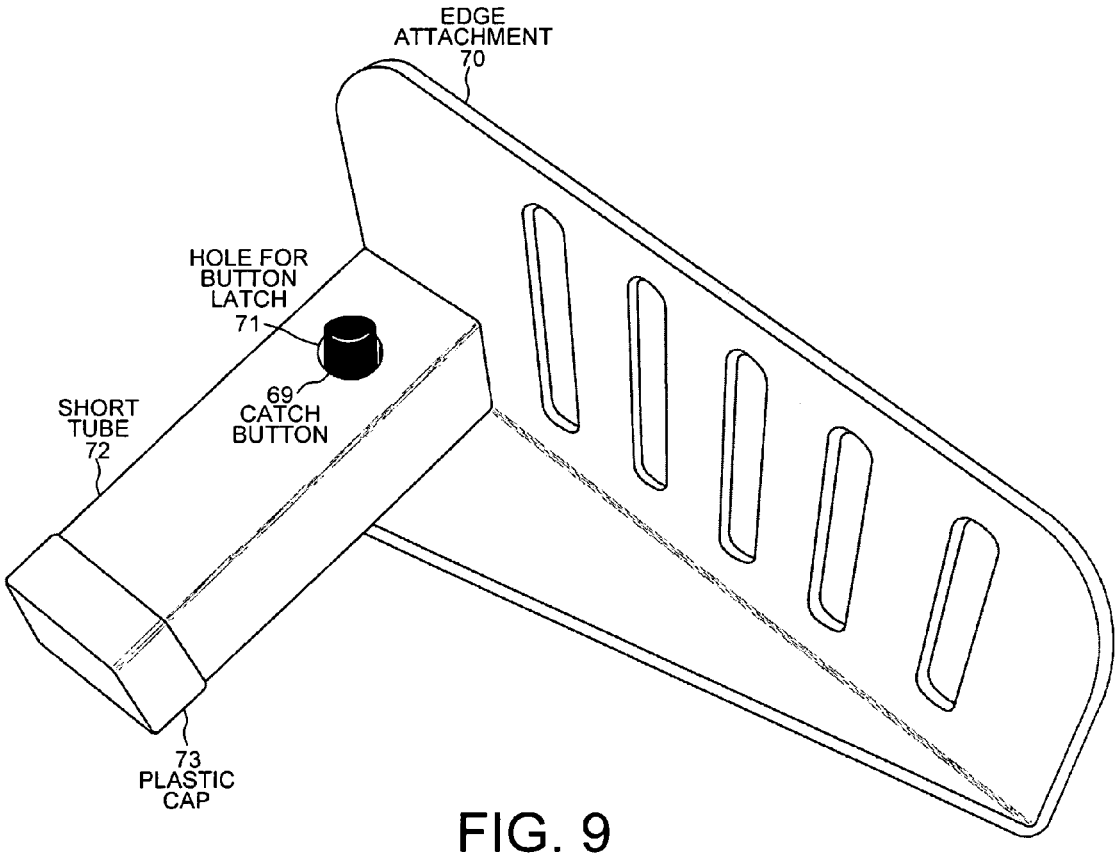
FIG. 9 is a detailed view of an edge attachment with a short tube that fits inside the end of a side rail.

FIG. 9 shows edge attachment 70 in more detail unattached to first lower portion 27. FIG. 9 shows depressible catch button 69 protruding through a hole 71 in a short tube 72 of an edge attachment 70. Short tube 72 is capped with a plastic cap 73. Short tube 72 fits inside the end of first lower portion 27. In the assembled condition, depressible catch button 69 protrudes through both hole 71 in short tube 72 as well as through hole 55 in first lower portion 27.

Figure 10:
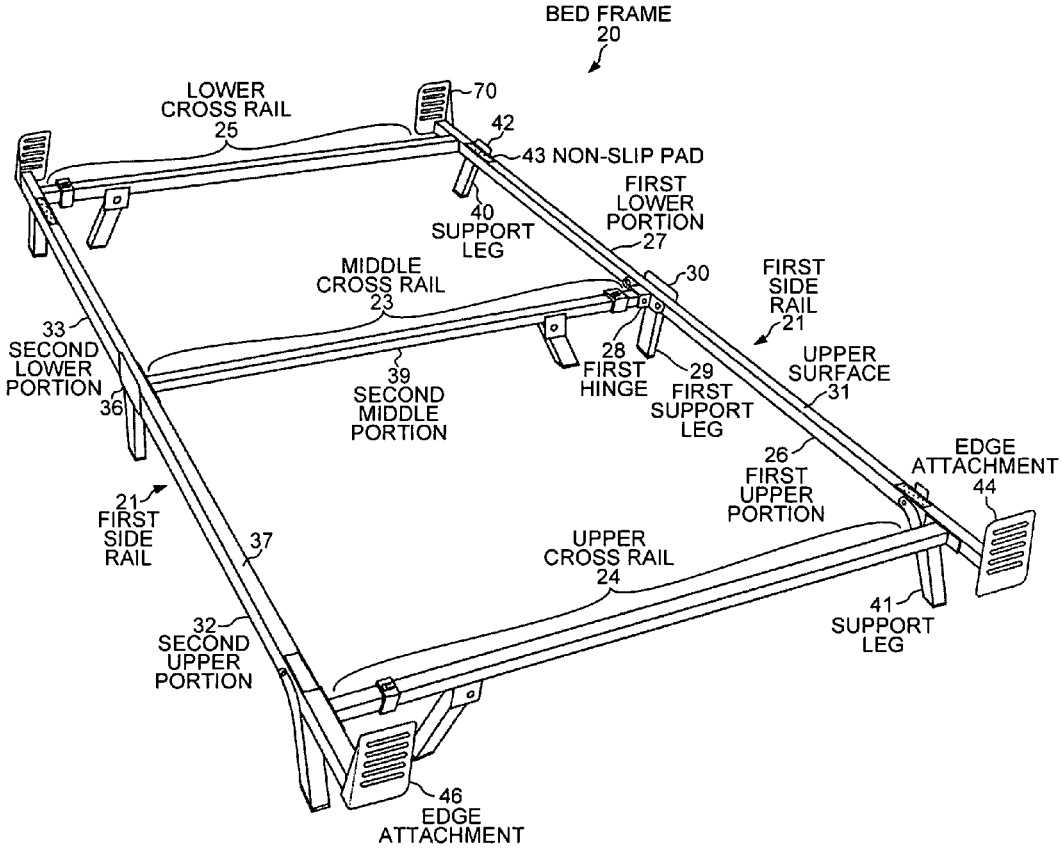
FIG. 10 is a perspective view the bed frame of FIG. 2 from the head of the bed.

FIG. 10 is a perspective view of bed frame 20 in the assembled condition from the head of the bed.

Figure 11:
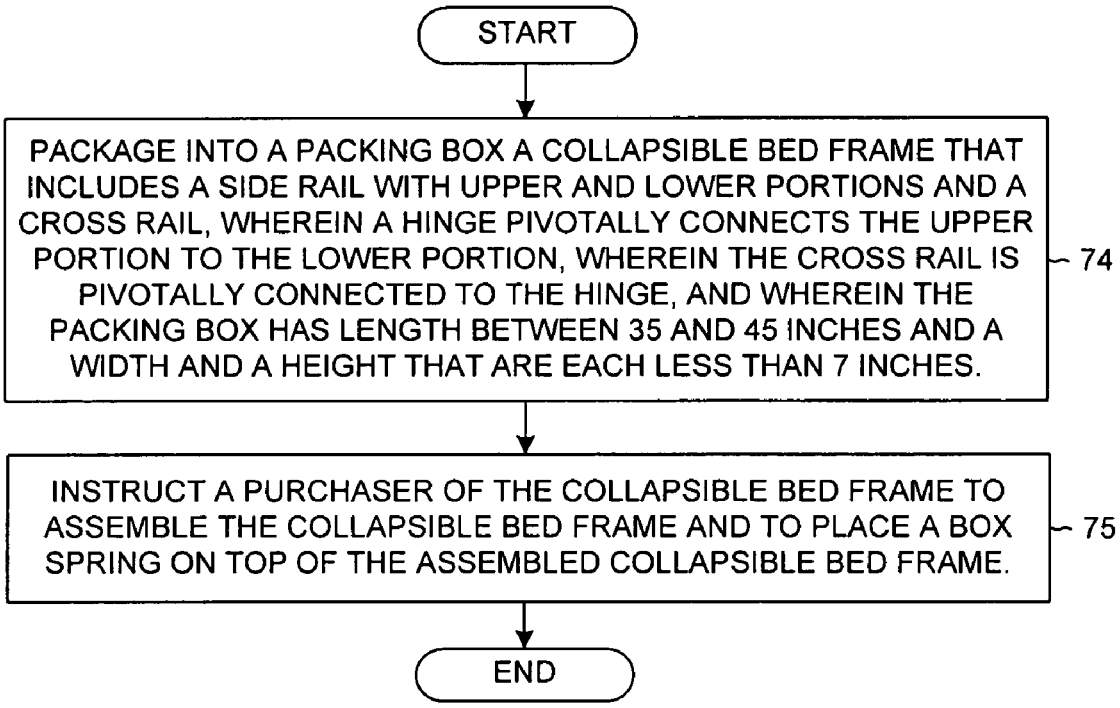
FIG. 11 is a flowchart of steps for packaging the bed frame of FIG. 2 into a packing box.

FIG. 11 is a flowchart of steps 74-75 for packaging collapsible bed frame 20 into a packing box for shipment from the manufacturer to a mass-market retail store. Step 74 describes packaging bed frame 20 into a packing box whose length is between 35 and 45 inches and whose width and height are each less than 7 inches. Step 75 involves instructing a purchaser of collapsible bed frame 20 to assemble the bed frame and to place a box spring on top of the assembled bed frame. The bed frame is sturdy but yet collapsible into a small size that fits into the aforementioned packing box because the bed frame includes a means for pivotally connecting upper and lower portions of a side rail and for pivotally connecting a cross rail to the means. The bed frame that is packaged in step 74 is light weight because it is made of hollow tubes having square cross sections that are made of metal having a thickness of less than one sixteenth of an inch.

Although certain specific exemplary embodiments are described above in order to illustrate the invention, the invention is not limited to the specific embodiments. Although the bed frame is described above as being constructed of metal, the bed frame may also be made of tubes of plastic. Although the side rails and cross rails are described as having a square cross section, the bed frame can also be made of rails having round cross sections. Accordingly, various modifications, adaptations, and combinations of various features of the described embodiments can be practiced without departing from the scope of the invention as set forth in the claims.

What is claimed is:

1. A bed frame comprising:

a first side rail including a first upper portion, a first lower portion and a first hinge, wherein the first upper portion has a length of at least 35 inches, wherein the first hinge pivotally connects the first upper portion to the first lower portion, wherein the first lower portion has a length that is about equal to the length of the first upper portion;

a middle cross rail including a first middle portion and a second middle portion, wherein the first middle portion is pivotally connected to the first hinge, wherein the second middle portion has a tongue, and wherein the first middle portion and the second middle portion telescope into one another; and a second side rail including a second upper portion, a second lower portion and a second hinge, wherein the second hinge pivotally connects the second upper portion to the second lower portion, wherein the second side rail has a slot, and wherein the tongue of the second middle portion fits into the slot of the second side rail.

2. The bed frame of claim 1, wherein the slot of the second side rail is disposed on the second hinge.

3. The bed frame of claim 1, wherein the first middle portion telescopes inside the second middle portion.

4. The bed frame of claim 1, further comprising:

a first support leg that is attached to the first hinge.

5. The bed frame of claim 4, further comprising:

a second support leg that is attached to the second hinge.

6. The bed frame of claim 1, further comprising:

a first support leg fixedly attached to the first hinge; and a second support leg pivotally attached to the first upper portion.

7. The bed frame of claim 1, wherein the first side rail has a square cross section.

8. The bed frame of claim 1, wherein the first side rail is a hollow tube of metal, wherein the hollow tube has a square cross section, and wherein the metal of the hollow tube has a thickness of less than one sixteenth of an inch.

9. The bed frame of claim 1, further comprising:

a support leg pivotally attached to the first lower portion, wherein the support leg pivots from a folded position to an extended position, wherein the support leg includes a flange that extends above the first lower portion when the support leg is in the extended position, and wherein the flange that does not protrude above the first lower portion when the support leg is in the folded position.

10. The bed frame of claim 9, wherein a box spring rests atop the bed frame, and wherein the flange holds the box spring in place over the bed frame.

11. A method comprising:

packaging a collapsible bed frame into a packing box, wherein the collapsible bed frame includes a side rail and a cross rail, wherein the side rail includes an upper portion, a lower portion and a hinge, wherein the hinge pivotally connects the upper portion to the lower portion, wherein the cross rail includes a first portion and a second portion that telescope into one another, wherein the first portion is pivotally connected to the hinge, wherein the packing box has a length that is longer than 35 inches and shorter than 45 inches, and wherein the packing box has a width and a height that are each less than 7 inches.

12. The method of claim 11, further comprising:

instructing a purchaser of the collapsible bed frame to assemble the collapsible bed frame and to place a box spring on top of the assembled collapsible bed frame.

13. The method of claim 11, wherein the side rail is a hollow tube of metal, wherein the hollow tube has a square cross section, and wherein the metal of the hollow tube has a thickness of less than one sixteenth of an inch.

14. The method of claim 11, wherein a support leg pivotally attached to the side rail, wherein the support leg pivots from a folded position to an extended position, wherein the support leg includes a flange that extends above the side rail when the support leg is in the extended position, and wherein the flange that does not protrude above the side when the support leg is in the folded position.

15. A collapsible bed frame comprising:

a first side rail that is longer than 70 inches, wherein the first side rail includes an upper portion and a lower portion that have approximately equal lengths;

a cross rail including a first portion and a second portion, wherein the first portion and the middle portion telescope into one another; and means for pivotally connecting the upper portion to the lower portion, wherein the first portion is pivotally connected to the means, and wherein the first side rail, the cross rail and the means fit inside a packing box having a length shorter than 45 inches and having a width and a height that are each less than 7 inches.

16. The collapsible bed frame of claim 15, further comprising:

a second side rail with a slot, wherein the second portion has a tongue, and wherein the tongue of the second portion fits into the slot of the second side rail.

17. The collapsible bed frame of claim 16, wherein the slot of the second side rail is disposed on a hinge.

18. The collapsible bed frame of claim 15, wherein the first side rail is a hollow tube of metal, wherein the hollow tube has a square cross section, and wherein the metal of the hollow tube has a thickness of less than one sixteenth of an inch.

19. The collapsible bed frame of claim 15, further comprising:

a support leg pivotally attached to the first side rail, wherein the support leg pivots from a folded position to an extended position, wherein the support leg includes a flange that extends above the first side rail when the support leg is in the extended position, and wherein the flange that does not protrude above the first side rail when the support leg is in the folded position.

20. The collapsible bed frame of claim 15, further comprising:

a first support leg fixedly attached to the means; and a second support leg pivotally attached to the upper portion.

* * * * *